US011339563B2

(12) United States Patent
Brodowski et al.

(10) Patent No.: US 11,339,563 B2
(45) **Date of Patent: *May 24, 2022**

(54) ADJUSTABLE FORMS FOR POURED CONCRETE STRUCTURES AND RELATED SYSTEMS AND METHODS

(71) Applicant: TRUETECH BRIDGE, LLC, Raleigh, NC (US)

(72) Inventors: David M. Brodowski, Dayton, OH (US); Zachary Wysong, Columbus, OH (US)

(73) Assignee: TRUETECH BRIDGE, LLC, Raleigh, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/009,053

(22) Filed: Sep. 1, 2020

(65) Prior Publication Data

US 2020/0392719 A1 Dec. 17, 2020

Related U.S. Application Data

(63) Continuation of application No. 15/951,935, filed on Apr. 12, 2018, now Pat. No. 10,801,198.

(60) Provisional application No. 62/485,220, filed on Apr. 13, 2017.

(51) Int. Cl.

| | |
|---|---|
| ***E04B 1/24*** | (2006.01) |
| ***E04B 5/40*** | (2006.01) |
| ***E01D 19/12*** | (2006.01) |
| *E01D 21/00* | (2006.01) |
| *E01D 101/24* | (2006.01) |

(52) U.S. Cl.

CPC ..... *E04B 1/2403* (2013.01); *E01D 19/125* (2013.01); *E04B 5/40* (2013.01); *E01D 21/00* (2013.01); *E01D 2101/24* (2013.01); *E04B 2001/2415* (2013.01); *E04B 2001/2418* (2013.01); *E04B 2001/2439* (2013.01); *E04B 2001/2463* (2013.01)

(58) Field of Classification Search

CPC ..... E01D 21/00; E04B 2001/2415; E04B 2001/2418; E04B 2001/2439

USPC ..... 14/77.1, 78; 249/211

See application file for complete search history.

(56) References Cited

U.S. PATENT DOCUMENTS

| | | | | |
|---|---|---|---|---|
| 2,215,972 A | | 9/1940 | Mueller et al. | |
| 3,960,357 A | * | 6/1976 | Honea, Jr. | E04G 17/18 249/211 |
| 4,074,499 A | | 2/1978 | Mess | |
| 4,123,031 A | * | 10/1978 | Hyre | E01D 21/00 14/77.1 |

(Continued)

FOREIGN PATENT DOCUMENTS

| | | |
|---|---|---|
| JP | 9-317068 | 12/1997 |

OTHER PUBLICATIONS

International Search Report and Written Opinion for corresponding International Application No. PCT/US2018/027343, dated Aug. 24, 2018 (11 pages).

*Primary Examiner* — Gary S Hartmann

(74) *Attorney, Agent, or Firm* — Bookoff McAndrews, PLLC

(57) ABSTRACT

An apparatus for adjusting a haunch height and related systems and methods includes a support angle. The support angle includes first and second flanges, and a surface of the first flange includes a hole. The apparatus also includes a coil rod and a rotatable nut.

20 Claims, 7 Drawing Sheets

(56) References Cited

U.S. PATENT DOCUMENTS

| | | | | |
|---|---|---|---|---|
| 5,092,559 | A | 3/1992 | Tjelle | |
| 5,901,396 | A | 5/1999 | Ahlskog et al. | |
| 6,273,393 | B1 | 8/2001 | McCoy | |
| 6,334,285 | B1 * | 1/2002 | Kirschner | E04B 9/18 248/228.1 |
| 6,412,132 | B1 | 7/2002 | Majnaric et al. | |
| 6,752,566 | B2 | 6/2004 | Smith | |
| 6,857,156 | B1 | 2/2005 | Grossman | |
| 6,898,905 | B1 * | 5/2005 | Kirschner | F16B 2/065 248/228.5 |
| 8,550,213 | B2 * | 10/2013 | Jorkama-Lopez | E04G 13/06 182/112 |
| 8,739,496 | B2 | 6/2014 | Brodowski | |
| 9,234,344 | B2 | 1/2016 | Hatzinikolas | |
| 10,801,198 | B2 * | 10/2020 | Brodowski | E01D 19/125 |
| 2007/0107339 | A1 * | 5/2007 | Matsumoto | E02D 27/32 52/295 |

* cited by examiner

ADJUSTABLE FORMS FOR POURED CONCRETE STRUCTURES AND RELATED SYSTEMS AND METHODS

CROSS-REFERENCE TO RELATED APPLICATIONS

This patent application is a continuation of U.S. application Ser. No. 15/951,935, filed on Apr. 12, 2018, which claims the benefit of priority under 35 U.S.C. § 119 to U.S. Provisional Patent Application No. 62/485,220, filed on Apr. 13, 2017, all of which are herein incorporated by reference in their entireties.

TECHNICAL FIELD

Aspects of the present disclosure generally relate to construction systems and procedures. Particular aspects relate to adjustable forms for poured concrete structures.

BACKGROUND

Constructing a concrete bridge deck typically involves formwork between bridge girders to temporarily support wet concrete until the concrete is cured. Once the concrete is cured, the formwork is no longer needed and is either removed or left in place. Bridge contractors use two types of formwork depending on the project requirements. The first type is removable forms, which are typically plywood supported on lumber. Wood formwork and other types of scaffolding which are removable may be placed at a location where a concrete member is to be placed, and then removed after the concrete member cures. The second type is stay-in-place forms, which are typically precast panels, corrugated steel deck forms, or transparent deck forms. Stay-in-place forms are used to make construction more simple and efficient. Stay-in-place forms may include corrugated metal sheets that span transversely between longitudinal beams, which can support material such as concrete while the concrete cures. One disadvantage of stay-in-place forms is the inability for a contractor or other suitable person to inspect the stay-in-place formwork for corrosion, integrity loss, or other deficiency in the concrete poured on the stay-in-place formwork during construction and also when the concrete has hardened and needs inspection during the life of the structure (e.g., concrete bridge deck).

Depending on the type of form and type of girder (typically precast concrete or steel beams), there are various connections for attaching the forms to the bridge girders to properly support the bearing loads at the form/girder interface. Once a form material and bridge type are known, a contractor is then responsible for designing and constructing an appropriate connection between the form and the girder. One important consideration for the connection is the ability to easily adjust the distance between the top of the girder and the bottom of the bridge deck, otherwise known as the haunch height. The haunch height is often specified by the bridge designer based on the girder camber and deck geometry such that a minimum deck thickness is maintained over the structure. However, it may be difficult to place the formwork such that the haunch height is constructed exactly per plan due to creep, shrinkage, variability in girder dimensions, and other factors related to bridge construction (e.g., settlement, temperature, material composition, etc.). Owing to the complexity involved in such a process, contractors generally make adjustments to the formwork elevations once the beams are set and just prior to the concrete deck pour to ensure the top and bottom of the concrete bridge deck will be at the specified elevations once the concrete deck construction is completed. Typically, once the formwork is installed between the girders, a dry-run is made to compare the measured concrete deck thickness to the specified thickness. If there are locations that need to be adjusted up or down, the contractor may make the alignment change, which then requires additional time and labor prior to placing the concrete.

When removable plywood forms are used, the contractor designs the support structure and connections to accommodate vertical adjustments with a hanger and coil rod system. These types of support structures include steel hangers placed over a girder, which are attached to a coil rod and nut (e.g., greased on the end embedded in the concrete for easy removal from the concrete once cured) such that when the nut is tightened, it raises the bottom of the formwork (e.g., plywood supported by lumber).

For stay-in-place forms, the contractor often looks to the formwork supplier to design the support structures and connections. Typically, these designs involve steel angles welded to the top flange of the bridge. The contractor has the ability to place the angles at the required elevations on the beams to achieve the designer's haunch height. Alternatively, the contractor may construct a ladder system where parallel angles are welded to a steel strap. The steel strap is welded along the vertical leg of the steel angle at exact locations measured by the contractor such that when the ladder is set on the girder, the form rests on the horizontal leg of the angle to achieve the desired haunch height.

While metal stay-in-place forms are used by contractors to achieve lower material cost, improved speed of construction, and less risk, they do, however, generally involve specialty labor, e.g., welders. One disadvantage of welding is that the protective coating over the steel support is removed, exposing the steel to potential corrosion. Once the steel is welded to the bridge, it may be very difficult to make even minor elevation adjustments.

It is, therefore, desirable to use a stay-in-place form, which has the ability to adjust the haunch height from the top surface of a bridge, similar to removable form systems, but without the need for welding and at lower cost (e.g., with fewer or without costly laborers). Additionally, it is desirable to use a stay-in-place form with the ability to adjust the haunch height without contractors or other laborers operating below the bridge deck forms.

SUMMARY

Aspects of the present disclosure relate to, among other things, methods and apparatuses for adjusting a haunch height that allows a contractor, or other suitable person, to adjust a haunch elevation from a top surface of a deck. In at least one aspect, the disclosure describes, among other things, a structure that allows a contractor to adjust a haunch elevation from a top surface of a deck without welding a form support to a girder. Each of the aspects disclosed herein may include one or more of the features described in connection with any of the other disclosed aspects.

In one aspect, an apparatus for adjusting a haunch height may include a support comprising a first flange and a second flange, wherein a surface of the first flange includes a hole. The apparatus may also include a coil rod at least partially extending through the hole, and a rotatable nut at least partially surrounding the coil rod, wherein motion of the rotatable nut adjusts a position of the support angle.

The apparatus may include any of the below aspects. The coil rod may be threaded. The threaded coil rod may be seated within a threaded coupler. The threaded coupler may be embedded in a flange of a bridge girder. The coil rod may be a first coil rod, and the apparatus may further include a bearing plate and a second coil rod. The bearing plate may be coupled to the first coil rod and to the second coil rod, and the second coil rod may extend parallel to the flange. The rotatable nut may be welded to the bearing plate. The apparatus may further include a coil rod splicer supporting at least a portion of the support angle.

The apparatus may further include an additional nut coupled to the coil rod and supporting at least a portion of the support angle. The apparatus may further include a washer or plate welded to the additional nut and supporting at least a portion of the support angle. The apparatus may be a stay-in-place form system configured to receive a concrete pour to form a bridge deck.

In another aspect, an apparatus for adjusting a haunch height may include a support angle, a strut angle, and an adjustable bearing angle coupled to the support angle. The apparatus may further include a coil rod at least partially extending through the support angle, and a rotatable nut at least partially surrounding the coil rod, wherein motion of the rotatable nut adjusts a position of the support angle.

The apparatus may further include any of the following aspects. The apparatus may further include a formwork. The strut angle may be slotted. The rotatable nut may be positioned on a portion of the coiled rod, and rotation of the rotatable nut may adjust a position of at least one of the support angle or the strut angle to adjust a position of the formwork. The apparatus may further include a support member and a panel coupled to the support member. The support member may include two longitudinal members and a plurality of crossbars. The longitudinal members and the crossbars may comprise steel, aluminum, or a combination thereof. At least a portion of the longitudinal members and the crossbars may include holes, and the longitudinal members and the crossbars may be joined together with a plurality of screws through the holes. The panel may be at least partially transparent.

In another aspect, a method of adjusting a haunch height may include mounting a haunch support to a flange of a bridge girder, the haunch support including a support element for a concrete pour, a coil rod, and a nut surrounding a portion of the coil rod and supporting at least a portion of the support element. The method may also include rotating the nut in order to adjust a position of the support element, thereby adjusting a height between the girder and the support element.

The haunch support may further include an angle positioned parallel to the girder. The nut may be rotated from a side of the flange opposite to the bridge girder, and the method may further comprise pouring concrete on the support element.

As used herein, the terms "comprises," "comprising," "includes," "including," or any other variation thereof, are intended to cover a non-exclusive inclusion, such that a process, method, article, or apparatus that comprises a list of elements does not include only those elements, but may include other elements not expressly listed or inherent to such process, method, article, or apparatus. Unless stated otherwise, the term "exemplary" is used in the sense of "example," rather than "ideal." The terms "approximately" and "about" refer to being nearly the same as a referenced number or value. As used herein, the terms "approximately" and "about" generally should be understood to encompass±5% of a specified amount or value.

It may be understood that both the foregoing general description and the following detailed description are exemplary and explanatory only and are not restrictive of the disclosure, as claimed.

BRIEF DESCRIPTION OF THE DRAWINGS

The accompanying drawings, which are incorporated herein, and constitute a part of this specification, illustrate exemplary aspects of the present disclosure and together with the description, serve to explain the principles of the disclosure.

DETAILED DESCRIPTION

The present disclosure is now described with reference to exemplary aspects of structure and construction methods for an adjustable bridge deck form. Some embodiments are depicted and/or described with reference to the structure and construction methods of an adjustable haunch with continuous angles, an adjustable haunch with continuous angles connect by a pair of straps, vertical and horizontal adjustable haunch supports with discontinuous angles, a vertical support adjustable haunch with continuous angle support, an adjustable haunch with integrated support and formwork, and/or an adjustable haunch with continuous angled support. These references are provided for convenience and are not intended to limit the present disclosure unless incorporated into the appended claims. Accordingly, the concepts and novelty underlying each embodiment may be utilized for any type of adjustable haunch, and may be made out of any material or materials.

The disclosure below provides structures and construction methods to adjust the haunch height of a bridge deck without the need for welding. As described above, while contractors often prefer stay-in-place forms over removable forms, bridge owners must contend with any consequences relating to welding steel angles to a top flange of a beam. Contractors are facing increased labor costs for specialty welding, and difficulties adjusting the haunch height once the weld is completed. To speed up construction, decrease labor costs, and make easier the adjustment of the haunch height, an adjustable connection without the need for welding is described below. Thus, the present disclosure describes a structure that may allow the contractor to adjust the haunch elevation, e.g., haunch height, from the top surface of the bridge deck without the need for welding the form support, e.g., formwork, to the girder. The embodiments of the present disclosure allow the contractor to adjust the height of the haunch more easily by, for example, tightening a nut from the top of the bridge deck surface. Unlike the removable formwork connection, however, the entire support system disclosed may stay in place with the form over the service life of the bridge deck.

Figure 1A:
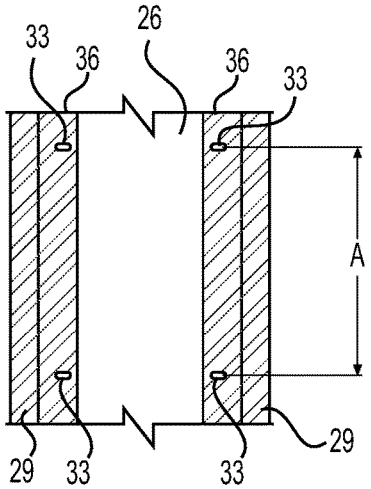
FIG. 1A is a top plan view of an adjustable haunch support system, according to an aspect of the present disclosure.
Figure 2A:
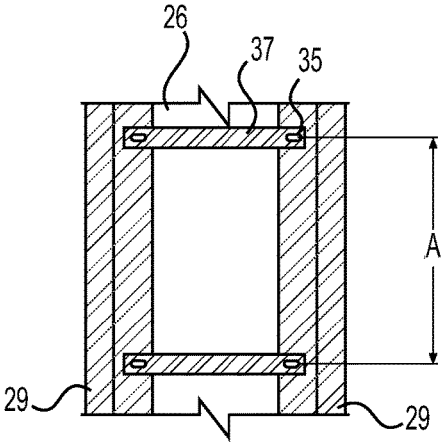
FIG. 2A is a top plan view of an adjustable haunch support system, according to an aspect of the present disclosure.

Exemplary aspects of the present disclosure are illustrated in FIGS. 1A-10B attached hereto. Referring now to the figures individually, FIGS. 1A and 1B depict an exemplary aspect in which an adjustable haunch form system comprises an adjustable haunch support system 22 with continuous angles for adjusting a haunch height 24.

Figure 1B:
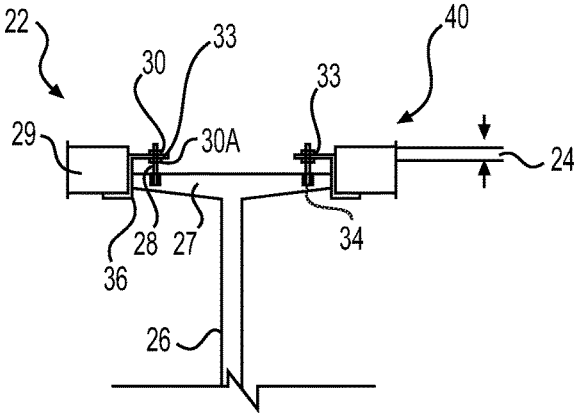
FIG. 1B is a cross-sectional view of the adjustable haunch support system of FIG. 1A.

Specifically, FIG. 1A and FIG. 1B depict an adjustable haunch support system 22, including a coil rod (or bolt) 28, a fastener, e.g., rotatable nut 30, and a support angle 36, positioned relative to a bridge girder 26. FIG. 1B depicts a cross-sectional plan view of support system 22, particularly with respect to an exemplary support angle 36 and formwork 29. FIG. 1A is a top plan view of support angle 36 including one or more holes 33. Holes 33 may be spaced apart a distance A, and the distance may be based on various design requirements. Coil rod 28, nut 30, and support angle 36 collectively form the adjustable haunch support system 22 to adjust a haunch height 24, as shown. Support angle 36 is generally shaped as an integral member of two opposing L-shaped members so that formwork 29 may be seated on an upward facing surface of support angle 36, as shown. Holes 33 may be located on a surface of support angle 36 for receiving coil rod 28. Holes 33 and coil rod 28 having similar diameter dimensions so that coil rod 28 may be inserted through holes 33 of support angle 36. Nut 30 may also have a diameter dimension similar (approximately equal) to the diameter dimensions of holes 33 and coil rod 28 so that coil rod 28, nut 30, and support angle 36 collectively cooperate to form haunch support system 22, as shown.

During operation of adjustable haunch support system 22, a contractor, or other suitable professional, may rotate nut 30 to adjust the vertical alignment, or haunch height 24, of support system 22 as described. Rotatable nut 30 is rotated in a direction (e.g., counter-clockwise or clockwise) to adjust support angle 36 in an upward (or downward) direction, thus adjusting the height between girder 26 and formwork 29. In some embodiments, a coupler 34 may be embedded in a top flange 27 of girder 26. In some examples, coupler 34 may be embedded in girder 26 when girder 26 is formed (e.g., coupler 34 is inserted within an unhardened, poured concrete flange of girder 26). In some embodiments, a complimentary nut 30A is inserted on the opposing face of a flange of support angle 36 to further secure coil rod 28 to support angle 36 and rotatable nut 30. In some examples, a combination of similar rod(s), bolt(s), coupler(s), and/or other suitable fastening mechanisms may be used to secure support angle 36 to girder 26 and formwork 29. A stay-in-place formwork system 40 is shown mounted to a surface of formwork 29, however, other suitable stay-in-place formworks may be used. In some examples, such stay-in-place formwork systems may be removably attached to formwork 29. In any such examples, a concrete pour may be poured over formwork 29 and support system 22 to construct a bridge deck. Girder 26 is shown as a concrete beam, but may comprise any other suitable material or combination of materials including, e.g., but not limited to, steel, iron, etc.

As shown in FIG. 1A, adjustable haunch support system 22 may be spaced along a longitudinal dimension of girder 26, e.g., based on design preferences, design requirements, and/or in order to achieve suitable haunch height adjustment. As shown, during operation of support system 22, support angle 36 is inserted between a bottom surface of formwork 29 and adjacent a side surface of flange 27 of girder 26. Coupler 34, coil rod 28, nut 30, and/or support angle 36 may comprise a metallic material (e.g., metal or metal alloy) such as steel, or other suitable load-bearing material(s). Specifically, adjustable haunch support system 22, of FIGS. 1A and 1B, may be utilized for a continuous support angle, as shown, between girder 26 and formwork 29. In some examples, as detailed below, discontinuous angles may exist between girder 26 and formwork 29.

Figure 2B:
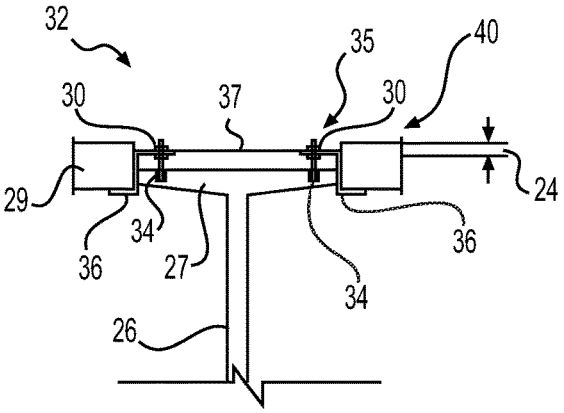
FIG. 2B is a cross-sectional view of the adjustable haunch support system of FIG. 2A.

Another aspect of the present disclosure includes an adjustable haunch form support system 32 comprising an adjustable haunch support 35 with continuous angles (see FIGS. 2A-2B) for adjusting haunch height 24 using removably connectable straps 37. Support system 32 may include any of the features of support system 22 described above. For purposes of clarity and brevity, similarly recited elements from support system 22 will not be described again. Removably connectable straps 37 may be used to connect each individual haunch support 35, as shown in a top plan view in FIG. 2A and in a cross-sectional view in FIG. 2B. Connectable straps 37 are inserted between rotatable nut 30 and a flange (not labeled) of support angle 36, as shown in FIG. 2B. Connectable straps 37 may comprise cold formed steel strips, hot-rolled bars configured into plates, bar stock, composite materials, or other suitable material(s). Connectable straps 37 may be used to create tension in overall support system 32 so that individual haunch adjustment supports 35 are held in tension with each other to establish structural rigidity. As described earlier, typical stay-in-place formwork system(s) may be installed on a surface of formwork 29, as shown.

Figure 3A:
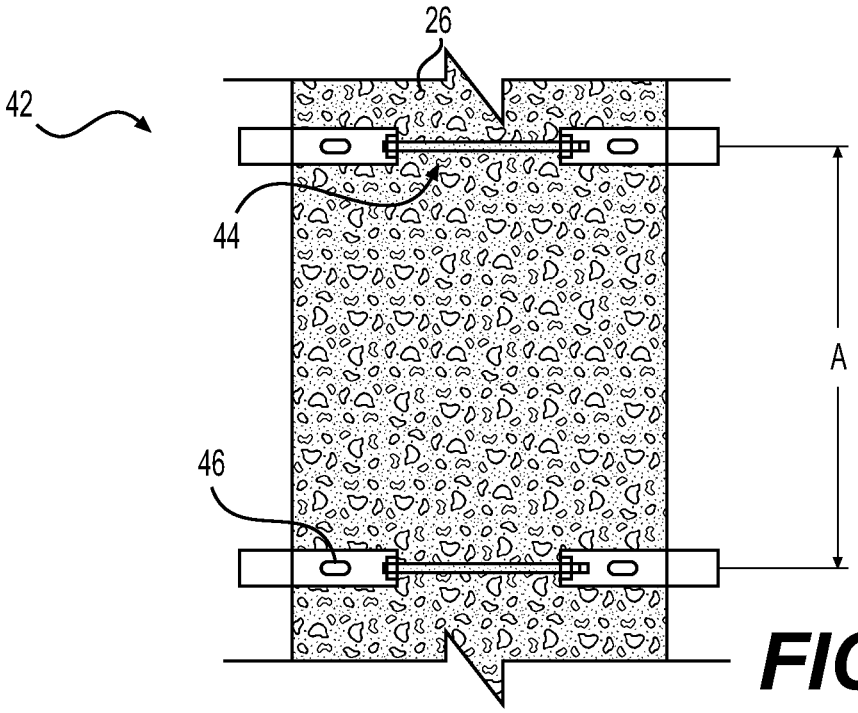
FIG. 3A is a top plan view of an adjustable haunch support system, according to an aspect of the present disclosure.
Figure 3B:
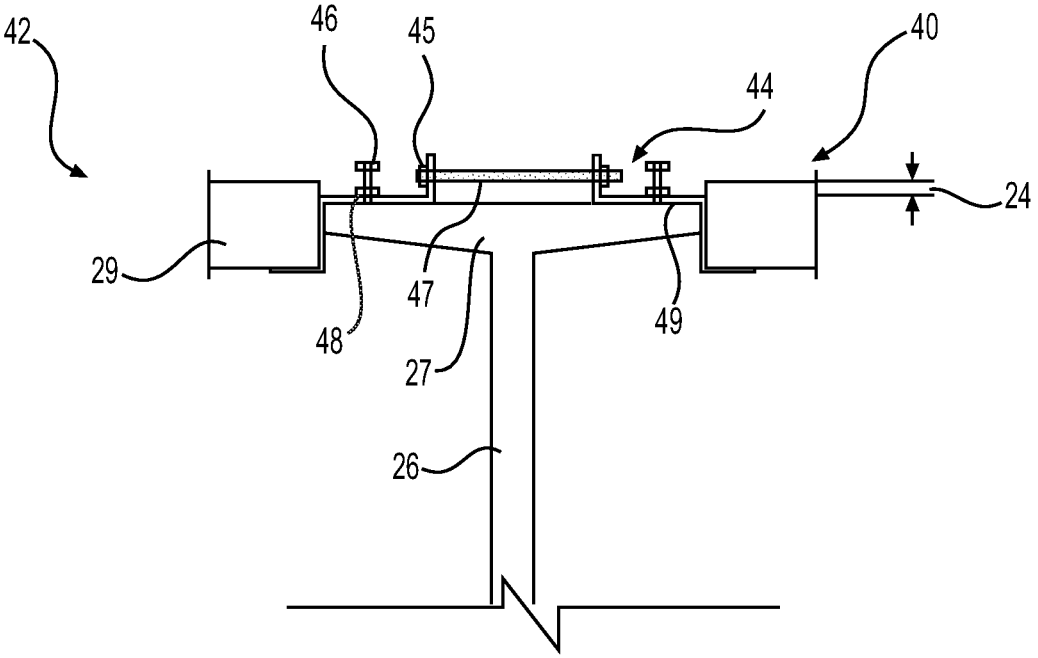
FIG. 3B is a cross-sectional view of the adjustable haunch support system of FIG. 3A.

Another aspect of the present disclosure includes an adjustable haunch form support system 42 comprising a horizontal adjustable haunch support 44 and a vertical adjustable haunch support 46 with discontinuous angles (see FIGS. 3A-3B) for adjusting haunch height 24. Support system 42 may include any of the features of support system 22 and/or support system 32 described above. For purposes of clarity and brevity, similarly recited elements from earlier support systems described above will not be described again. As shown in system 42, a contractor, or other suitable professional may adjust the system 42 horizontally and/or vertically. Horizontal support 44 may be manipulated using a rotatable nut 45 and a coil rod 47 to horizontally adjust vertical supports 46, as shown. During operation of system 42, a contractor, or other suitable professional, may manipulate or rotate nut 45 so as to horizontally adjust vertical supports 46 inwardly (or outwardly) from a center of girder 26. Vertical supports 46, similarly as described above, may be adjusted to vertically adjust a flange 27 of girder 26 to be brought upwardly (or downwardly) with a bottom surface of formwork 29. In some examples, as shown in FIG. 3B, a nut 48 may be welded to a bearing plate 49 of vertical support 46. Bearing plate 49 may be load bearing, and may be used to shoulder additional load (or weight) during installation of support system 42. In some examples, bearing plate 49 may be used to help distribute bearing loads over a larger area of the top flange to reduce stress.

Figure 4:
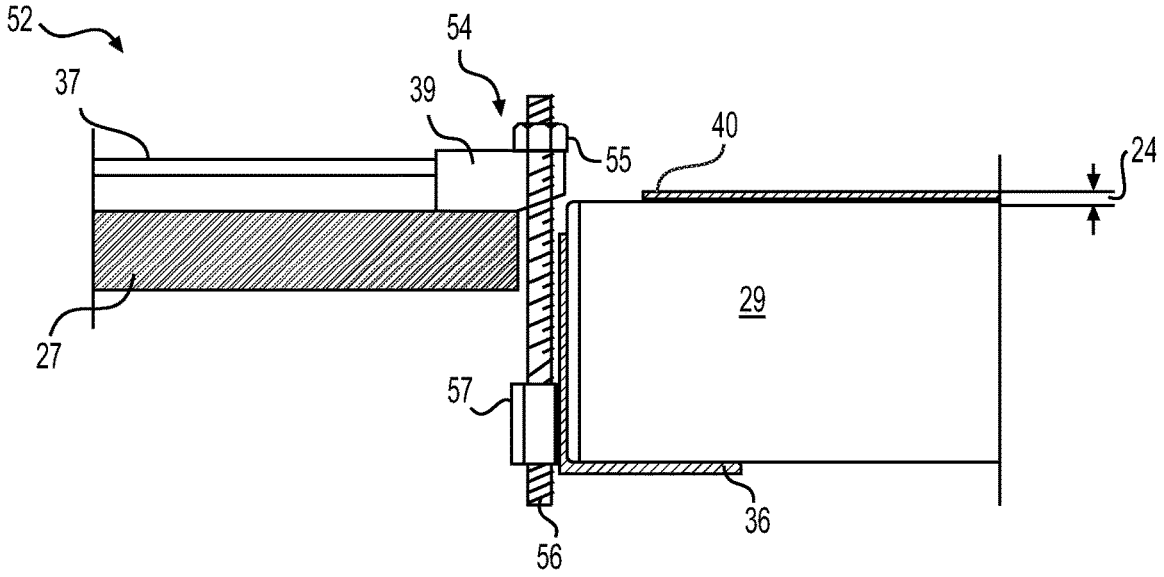
FIG. 4 is a cross-sectional view of an adjustable haunch support system with a continuous angle support, according to an aspect of the present disclosure.

Another aspect of the present disclosure includes an adjustable haunch form support system 52 comprising a vertical adjustable haunch support 54 with continuous angles (see FIGS. 4-5) for adjusting haunch height 24. Support system 52 may include any of the features of support systems 22, 32, and/or 42 described above. For purposes of clarity and brevity, similarly recited elements from earlier support systems described above will not be described again. As shown in system 52, a contractor, or other suitable professional, may adjust haunch height 24 using adjustable support 54. FIG. 4 depicts adjustable support 54 comprising a coil rod 56, a coil rod splicer 57, a rotatable nut 55, and support angle 36. During operation of system 52, a contractor, from a top surface of formwork 29, may rotate or manipulate nut 55 to vertically adjust coil rod splicer 57, as shown to adjust haunch height 24. In some examples, coil rod splicer 57 may be welded to support angle 36, as shown, or otherwise suitably mounted, in order to secure coil rod 56 to support angle 36. In FIG. 4, nut 55 may be seated on a surface of, or within, an end support 39 of connectable straps 37. In some examples, system 52 does not include connectable straps 37 or connectable straps 37 are not used.

Figure 5:
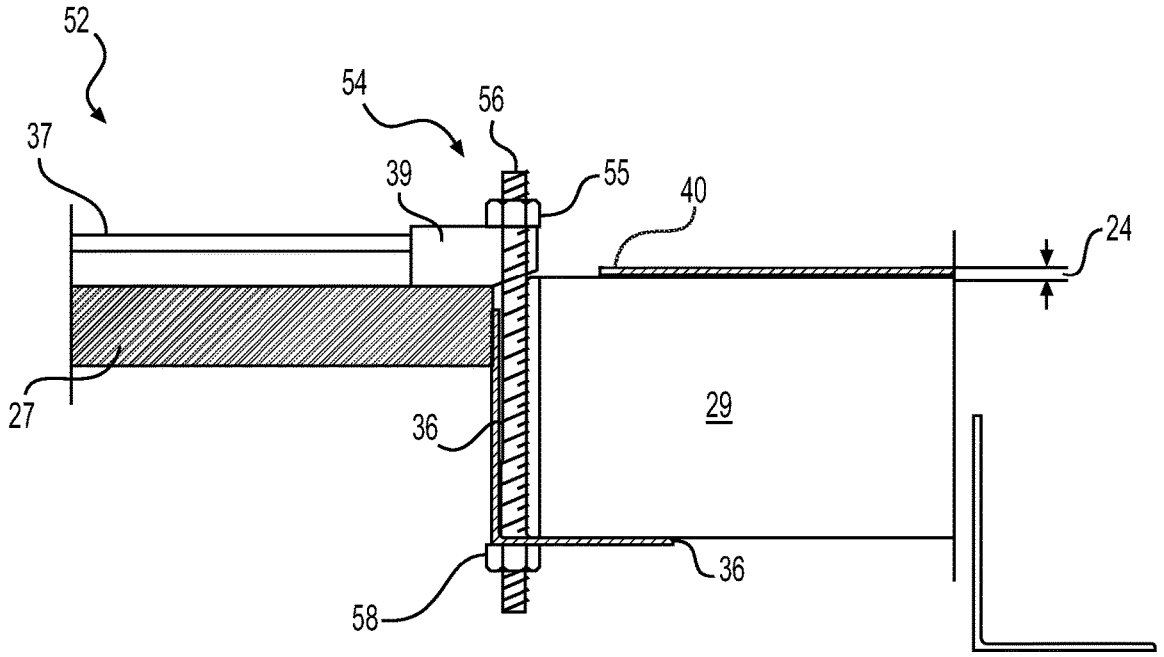
FIG. 5 is a cross-sectional view of an adjustable haunch support system with a continuous angle support, according to an aspect of the present disclosure.

FIG. 5 depicts an embodiment of adjustable support 54 where coil rod 56 is secured to support angle 36 via nut 58. During operation of system 52 of this embodiment, a contractor rotates nut 55 to vertically adjust (upwardly or downwardly) support angle 36 to adjust haunch height 24. In FIG. 5, coil rod 56 may be welded to support angle 36 and nut 58, or otherwise suitably mounted.

Figure 6:
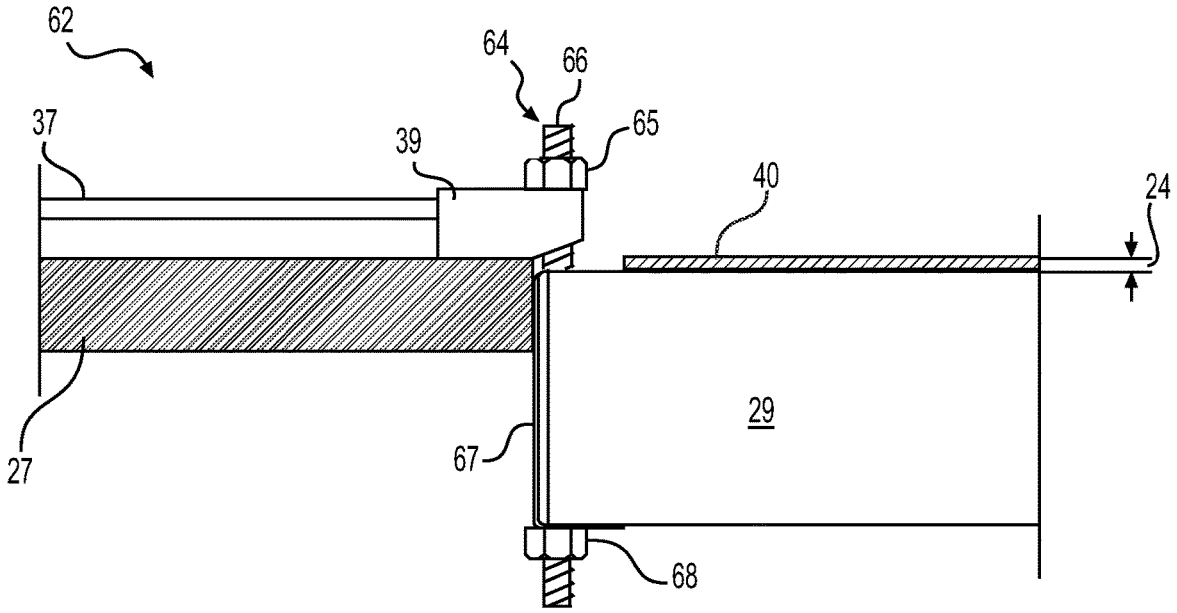
FIG. 6 is a cross-sectional view of an adjustable haunch support system with an integrated support, according to an aspect of the present disclosure.

Another aspect of the present disclosure includes an adjustable haunch form support system 62 comprising a vertically adjustable haunch support 64 with an integrated support 67 (see FIG. 6) for adjusting haunch height 24. Support system 62 may include any of the features of support systems 22, 32, 42, and/or 52 described above. For purposes of clarity and brevity, similarly recited elements from earlier support systems described above will not be described again. As shown in FIG. 6, integrated support 67 may be integral with formwork 29. In some examples, integrated support 67 may be removably attached to formwork 29. A support angle is not included in support system 62 to adjust haunch height 24. Owing to integrated support 67, a contractor, or other suitable professional, may rotate or manipulate a nut, e.g., first nut 65, coupled to coil rod 66 and another nut, e.g., second nut 68, to adjust haunch height 24. Nut 68 may be welded to coil rod 66, in some examples. Integrated support 67 may be comprised from channel, track, angled, or W-shaped sections of steel or other appropriate material(s).

Figure 7:
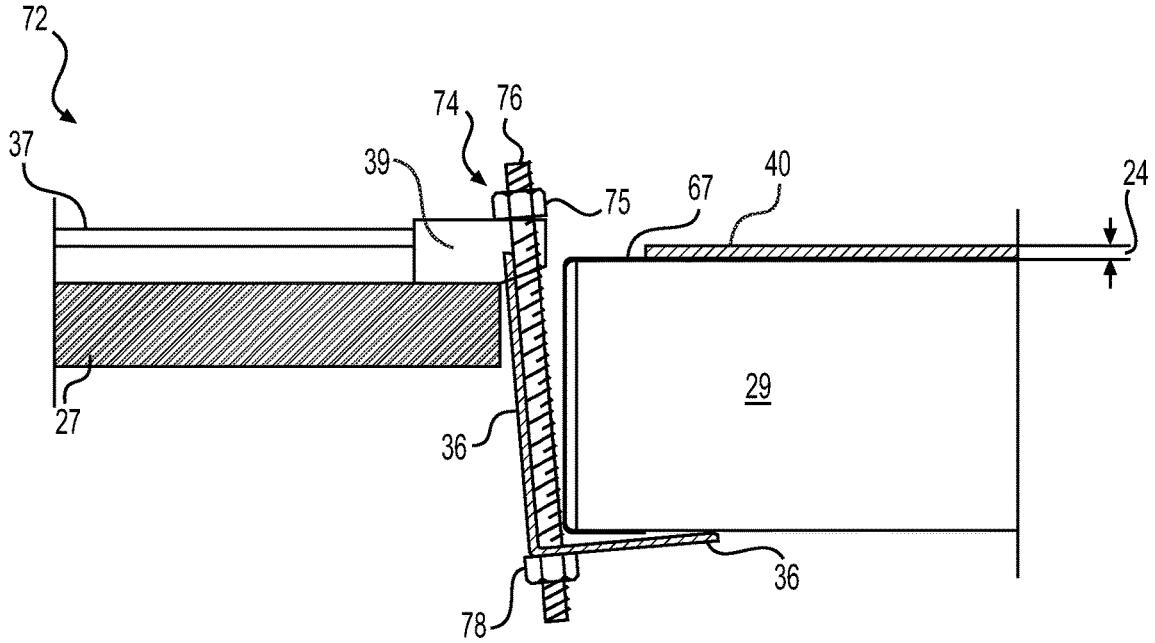
FIG. 7 is a cross-sectional view of an adjustable haunch support system with a continuous angled support, according to an aspect of the present disclosure.

A further aspect of the present disclosure includes an adjustable haunch form support system 72 comprising a vertically adjustable haunch support 74 for continuous angled support (see FIG. 7) for adjusting haunch height 24. In some examples, integrated support 67 of support system 62 may be used with formwork 29, as shown. Support system 72 may include any of the features of support systems 22, 32, 42, 52, and/or 62 described above. For purposes of clarity and brevity, similarly recited elements from earlier support systems described above will not be described again. As FIG. 7 depicts, support angle 36 may be mounted such that formwork 29 may be seated on a surface of support angle 36 to provide continuous angle support of girder (not shown) with formwork 29 along a longitudinal axis of girder 26. In some examples, support angle 36 may lie at an angle of 0 to 30 degrees from a face of formwork 29 and/or a face of flange 27 of girder. This angled configuration may counteract an eccentric bearing load on support angle 36. Since the bearing force acts on a horizontal leg of support angle 36, a distance away from a vertical leg of support angle 36, a force couple, e.g., a bending moment, is created in coil rod 76. By positioning support angle 36 at an angle, the bending moment is reduced. Coil rod 76 may be welded to nut 78 and/or support angle 36. During operation of system 72, rotatable nut 75 of haunch support 74 may be rotated to adjust haunch height 24.

Figure 8:
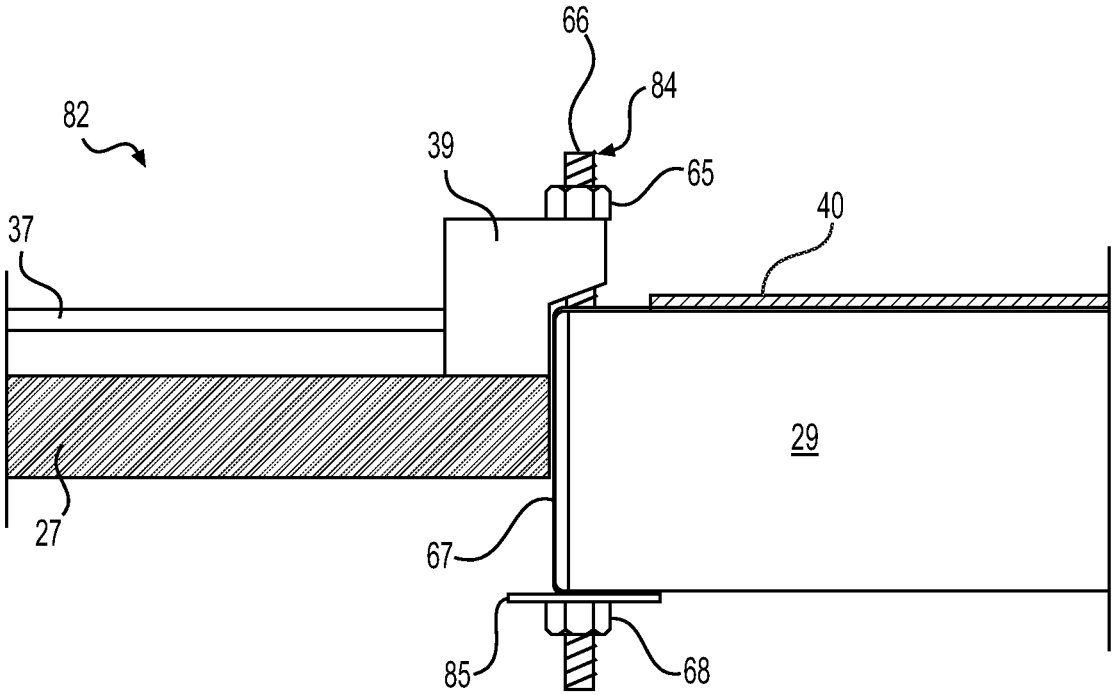
FIG. 8 is a cross-sectional view of an adjustable haunch support system with an integrated support, according to an aspect of the present disclosure.

With reference to FIG. 8, a further aspect of the present disclosure includes an adjustable haunch form support system 82 comprising a vertically adjustable haunch support 84, similar to haunch support 64 of support system 62, for adjusting haunch height 24. Support system 82 may include any of the features of support systems 22, 32, 42, 52, 62, and/or 72 described above. For purposes of clarity and brevity, similarly recited elements from earlier support systems described above will not be described again. As shown in FIG. 8, a washer or plate 85 may be utilized with haunch support 84. Washer or plate 85 may comprise steel or other suitable material(s). In some examples, washer or plate 85 may be welded to nut 68 and/or coil rod 66. In some examples, integrated support 67 may abut a surface of washer or plate 85, as shown in FIG. 8.

Figure 9A:
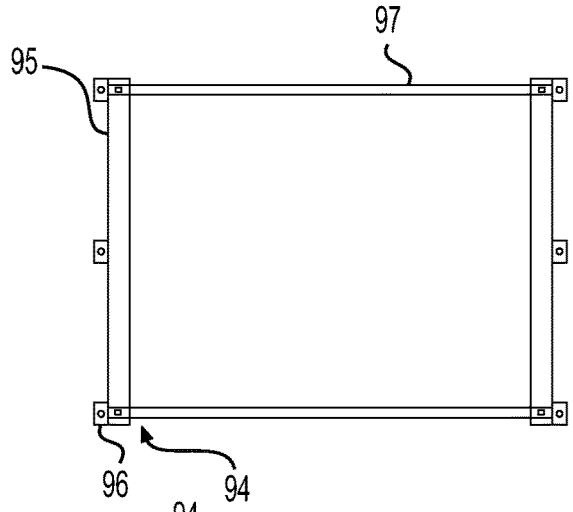
FIG. 9A is a top plan view of an adjustable haunch support system, according to an aspect of the present disclosure.
Figure 9B:
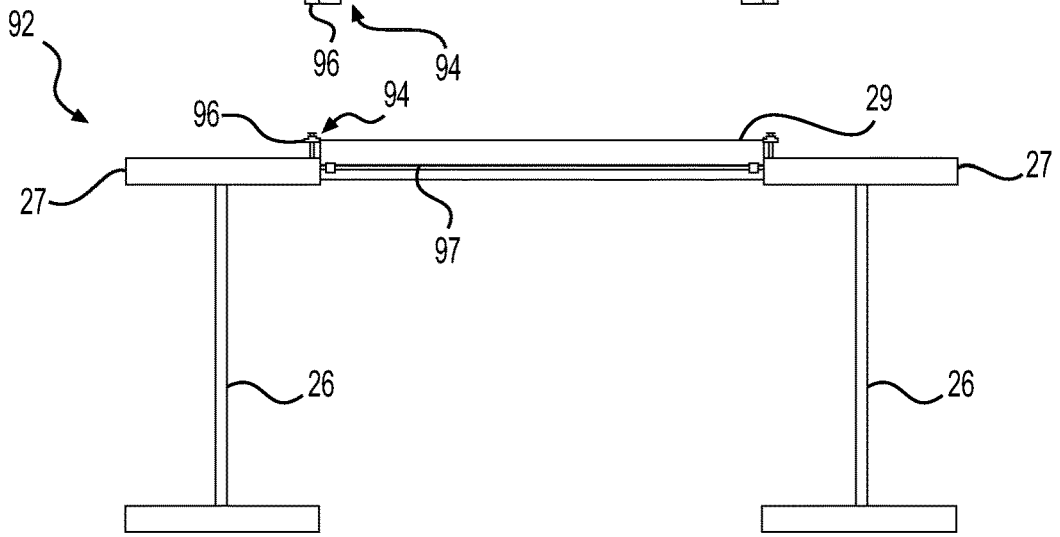
FIG. 9B is a cross-sectional view of the adjustable haunch support system of FIG. 9A.
Figure 9C:
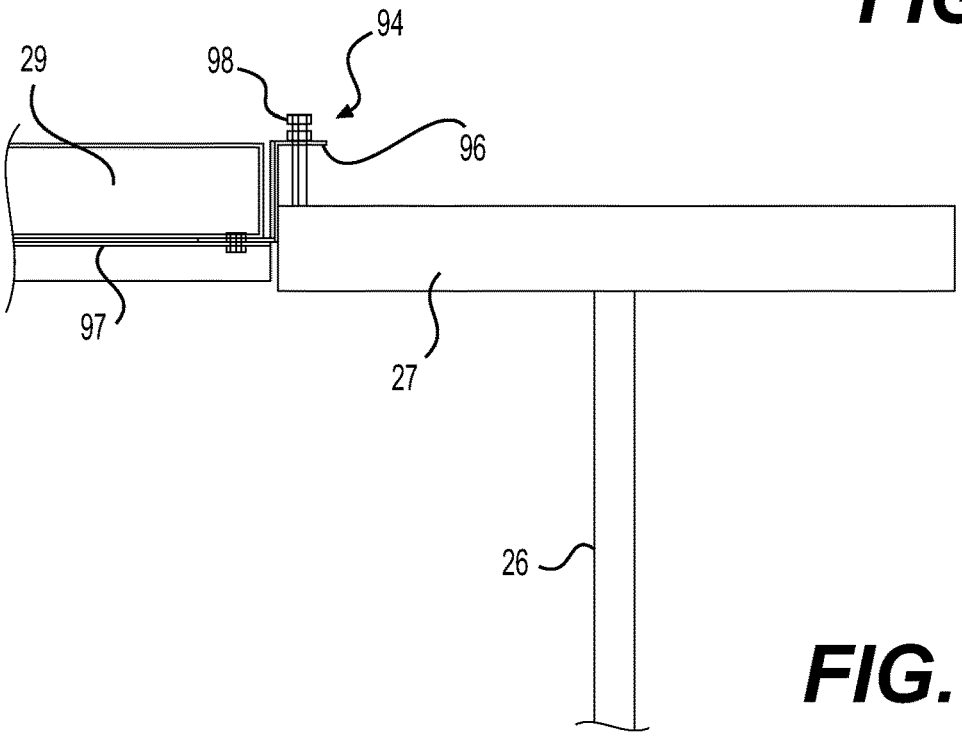
FIG. 9C is a cross-sectional view of the adjustable haunch support system of FIG. 9A.

With reference to FIGS. 9A, 9B, and 9C, a further aspect of the present disclosure includes an adjustable haunch form support system 92 comprising a vertically adjustable haunch support 94. Support system 92 may include any of the features of support systems 22, 32, 42, 52, 62, 72, and/or 82 described above. For purposes of clarity and brevity, similarly recited elements from earlier support systems described above will not be described again. Haunch support 94 may comprise a support angle 95, an adjustable bearing angle 96, a strut angle 97, and a nut 98. Support angle 95 may be formed from a piece of metal or metal alloy, or other suitable load-bearing material(s). In some examples, support angle 95 connects individual haunch supports 94, as shown in FIG. 9A. Adjustable bearing angle 96 may be shop welded, or connected using another suitable manner, to support angle 95. Strut angle 97 may be slotted or non-slotted. In embodiments where strut angle 97 is slotted, strut angle 97 may be configured to receive a field bolt (not shown). Formwork 29 may be deposited as shown in FIG. 9B.

Figure 10A:
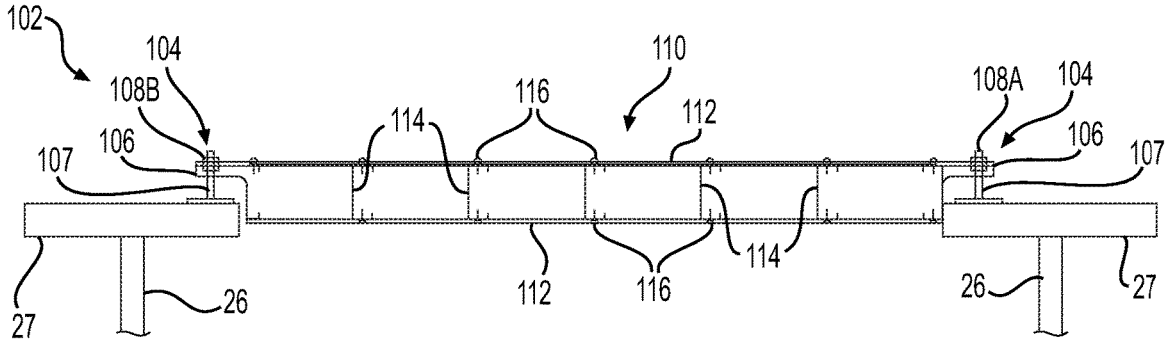
FIG. 10A is a cross-sectional view of an adjustable haunch support system, according to an aspect of the present disclosure.

With reference to FIG. 10A, a further aspect of the present disclosure includes an adjustable haunch form support system 102 comprising a vertically adjustable haunch support 104. Support system 102 may include any of the features of support systems 22, 32, 42, 52, 62, 72, 82, and/or 92 described above. For purposes of clarity and brevity, similarly recited elements from support systems described above will not be described again. Haunch form support system 102 may include two adjustable haunch supports 104, for example, with each haunch support 104 coupled to respective top flanges 27 of adjacent girders 26. Haunch supports 104 may be coupled to a formwork (not shown). Alternatively, as shown in FIG. 10A, haunch supports 104 may be coupled to a support member 110.

Support member 110 may be coupled to flanges 27 via one or more coil rods, nuts, washers, or plates as discussed above. For example, nut 108A may couple support member 110 to a first flange 27 via an adjustable bearing angle 106 and coil rod 107. Similarly, nut 108B may couple support member 110 to a second flange 27 via another adjustable bearing angle 106 and coil rod 107. The connection via nut 108A may be static, and support member 110 may abut flange 27 where connected by nut 108A. In one aspect, however, the connection via nut 108B may be adjustable. For example, nut 108B may be coupled to a slot in either bearing angle 106 or flange 27 such that the position of bearing angle 106, coil rod 107, and/or nut 108B, and thus support member 110 may be adjustable relative to flange 27. The adjustability may allow for a contractor to selectively position support member 110 relative to girders 26, and thus relative to the bridge deck. For example, if girders 26 are not fully aligned, the adjustability of one side of support member 110, for example, via bearing angle 106B, may allow a contractor to make adjustments to ensure that support member 110 is flat or otherwise properly positioned to support the poured concrete. Additionally, although not shown, adjustable haunch form system 102 may include additional wedge or angle elements similar to support angle 95 and strut angle 97 of FIGS. 9A-9C to enclose a side or top portion of support element 110 to receive a concrete pour.

Figure 10B:
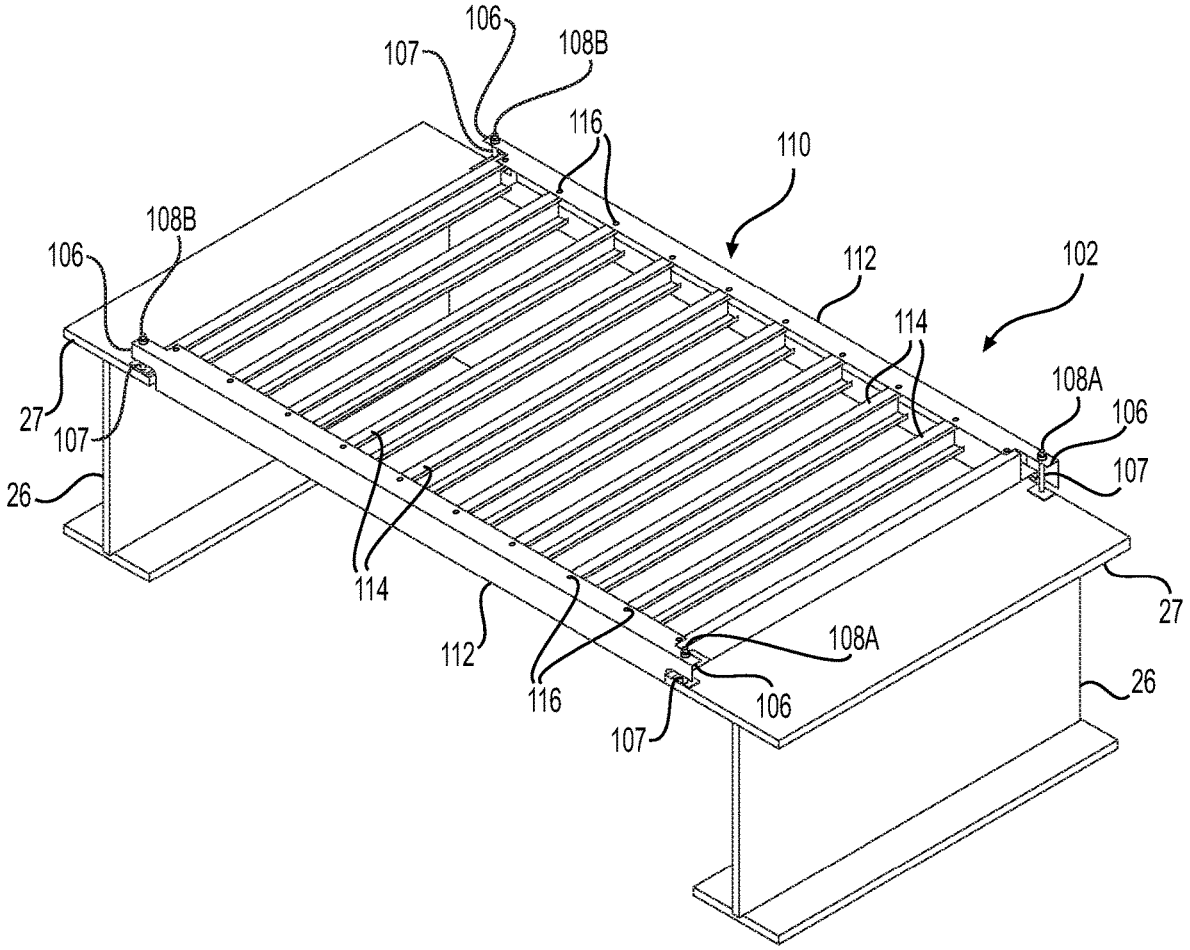
FIG. 10B is a perspective view of a portion of the adjustable haunch support system of FIG. 10A.

FIG. 10B illustrates a perspective view of support member 110 mounted on flanges 27 of girders 26. The mounting of support member 110 on flanges 27 is simplified for clarity, but it is noted that support member 110 may be mounted on flanges 27 using any of the aforementioned adjustable haunch support systems and/or methods. As shown in FIG. 10B, support member 110 may include two longitudinal bars 112, with a plurality of crossbars 114 extending between longitudinal bars 112, for example, parallel to flanges 27. In one aspect, longitudinal bars 112 may comprise aluminum, and may be approximately 3 to 9 feet depending on the bridge deck system and the spacing of girders 26. Crossbars 114 may be coped bars, and may be approximately 4 feet long, spanning a distance between longitudinal bars 112. Alternatively, crossbars 114 may be other shapes, such as, for example, I-beams. In one aspect, crossbars 114 may be steel or aluminum studs.

Referring to FIGS. 10A and 10B, crossbars 114 may be fixedly coupled to longitudinal bars 112 via a plurality of rivets or screws 116. Crossbars 114 and screws 116 may be positioned approximately every 8 to 16 inches along longitudinal bars 112. In one aspect, longitudinal bars 112 and crossbars 114 may include pre-punched or pre-drilled holes in positions that correspond to the couplings of longitudinal bars 112 and crossbars 114 via screws 116.

Longitudinal bars 112 and crossbars 112 may support a panel (not shown). The panel may be formed of an acrylic or plastic, and may be at least partially clear or transparent. The panel may be preformed, and may be approximately ¼, ½, ¾, 1, or 2 inches thick. The panel may be approximately the same area as a top portion of support member 110, and may be secured to at least one of longitudinal bars 112 and crossbars 114 via an adhesive or other coupling mechanism. The panel may be the base of the concrete poured on support member 110 to form an at least partially transparent stay-in-place bridge deck. Support member 110, including the panel, may be sacrificial and remain coupled to girders 26 in the finalized bridge deck. As such, a contractor, an inspector, etc. may view and inspect various portions of the poured concrete from beneath the bridge deck during the construction and lifetime of the bridge deck. Additionally, support member 110 may be prefabricated and formed of stock materials for quick and/or easy coupling to girders 26.

Some attributes of the previously described structures, systems, and construction methods for an adjustable haunch are recited here but are not exclusive of features or benefits of the present disclosure. The systems disclosed herein may include one or more of the following attributes. One attribute of the adjustable haunch features described herein is for the ability to adjust the haunch height from a top surface of a bridge deck. Other attributes include avoiding the need to retain or hire specialty labor, e.g., welders and carpenters, which are not be needed to install the support structure of the adjustable haunch. One other attribute is avoiding the need for welding for an attachment of the support structure to the bridge girder, as detailed above, which may reduce the risk of corrosion over time. Furthermore, the structures, systems, and construction methods discussed herein may further include the positioning and/or support of reinforcement members (e.g., rebar) in the portions of the bridge deck to receive the concrete.

Other attributes of the systems herein include the ability to install the adjustable haunch on precast concrete, steel, timber girders, or girders made from other suitable material, all of which may be both continuously and suitably supported. Welding procedures are typically not allowed in negative bending moment regions of continuous bridge girders, however, the support structures and systems described in this disclosure may be used consistently across the bridge in negative bending moment regions of continuous bridge girders, as well as in positive bending moment regions.

Other attributes of the adjustable haunch support systems described above include, for example, eliminating the requirement for specialized inserts or holes in a top flange of precast girders, or other suitable support beams. These attributes, consequently, may save material and precast concrete labor costs.

Additional attributes of the systems described herein may also include improved safety. In some examples, most or all connections and adjustments may be made from the top of the bridge deck. In doing so, the systems herein may reduce or avoid the need for laborers, or other similar construction workers, below the bridge deck to remove any of the support systems described above once the concrete is cured. Consequently, the risk of a laborer being injured on the site may be reduced.

Lastly, the support systems detailed above may be manufactured at reduced costs compared to other support systems. For example, the support systems detailed above may be manufactured using a simple, repeatable, and modular process. The support systems may be modular to help in reducing the material cost over time, which may make it simple for contractors, or other suitable professionals, to install.

While principles of the present disclosure are described herein with reference to illustrative aspects for particular applications, it should be understood that the disclosure is not limited thereto. Those having ordinary skill in the art and access to the teachings provided herein will recognize additional modifications, applications, examples, and substitution of equivalents all fall within the scope of the aspects described herein. Accordingly, the present disclosure is not to be considered as limited by the foregoing description.

What is claimed is:

1. An apparatus for adjusting a haunch height for a horizontal panel, the apparatus comprising:

a support system, the support system comprising a vertical support portion with a first flange and a horizontal support portion with a second flange, wherein a surface of the support system includes a hole, wherein the support system is configured to support the horizontal panel;

a first coil rod at least partially extending through the hole;

a first rotatable nut at least partially surrounding the first coil rod, wherein motion of the first rotatable nut adjusts a position of the vertical support portion of the support system to adjust a height of the horizontal panel; and a second coil rod, wherein the vertical support portion of the support system is coupled to the first coil rod and the horizontal support portion of the support system is coupled to the second coil rod, and wherein, when the apparatus is mounted to a flange of a bridge girder, the second coil rod extends parallel to the flange of the bridge girder.

2. The apparatus of claim 1, wherein the coil rod is threaded.

3. The apparatus of claim 2, wherein the threaded coil rod is seated within a threaded coupler.

4. The apparatus of claim 3, further comprising:

a coupler, wherein a portion of the first coil rod is seated within the coupler, wherein the coupler is configured to be embedded within the flange of the bridge girder, and wherein the threaded coupler is embedded in the flange of the bridge girder.

5. The apparatus of claim 1, wherein the first rotatable nut is welded to the vertical support portion of the support system.

6. The apparatus of claim 1, further including a coil rod splicer supporting at least a portion of the support system.

7. The apparatus of claim 1, further including:

a second rotatable nut coupled to the first coil rod and supporting at least a portion of the support system; and a washer or plate welded to the second rotatable nut and supporting at least a portion of the support system.

8. The apparatus of claim 1, wherein the apparatus is a stay-in-place form system configured to receive a concrete pour to form a bridge deck.

9. The apparatus of claim 1, wherein the support system is formed of a steel.

10. The apparatus of claim 1, further comprising a slotted strut angle configured to receive a field bolt, and a formwork, wherein rotation of the rotatable nut adjusts a position of at least one of the support system or the strut angle to adjust a position of the formwork.

11. The apparatus of claim 10, further comprising a support member and an at least partially transparent panel coupled to the support member.

12. The apparatus of claim 4, wherein the support system is a first support system, and wherein the second coil rod extends parallel to the flange of the bridge girder to a second support system positioned on another side of the flange of the bridge girder.

13. The apparatus of claim 1, further comprising at least one connectable strap, wherein the at least one connectable strap is positioned between the first rotatable nut and the first flange of the support system.

14. An apparatus for adjusting a position of a horizontal panel, the apparatus comprising:

a vertical adjustable haunch support comprising:

a support angle, the support angle comprising a first flange and a second flange, wherein a surface of the first flange includes a hole;

a first coil rod at least partially extending through the hole; and a first rotatable nut at least partially surrounding the first coil rod, wherein motion of the first rotatable nut adjusts a vertical position of the support angle;

a horizontal adjustable haunch support, comprising:

a second coil rod;

a bearing plate; and a second rotatable nut at least partially surrounding the second coil rod, wherein motion of the second rotatable nut adjusts a horizontal position of the support angle; and a coupler configured to be embedded within a flange of a bridge girder, wherein the first coil rod is seated within the coupler, wherein the bearing plate is coupled to the first coil rod and to the second coil rod, and wherein, when the coupler is embedded within the flange of the bridge girder, the second coil rod extends parallel to the flange of the bridge girder.

15. The apparatus of claim 14, wherein the support angle is a first support angle, wherein the bearing plate is a second support angle that forms another horizontal adjustable haunch support, and wherein the second coil rod couples the horizontal adjustable haunch support to the another bearing plate of another horizontal adjustable haunch support.

16. The apparatus of claim 14, wherein the support angle is formed of a steel.

17. The apparatus of claim 14, wherein the apparatus is a stay-in-place form system configured to receive a concrete pour to form a bridge deck.

18. An apparatus for adjusting a haunch height for a horizontal panel, the apparatus comprising:

a support system, the support system comprising a vertical support portion with a first flange and a horizontal support portion with a second flange, wherein a surface of the vertical support portion includes a hole, wherein the support system is configured to support the horizontal panel;

a first coil rod at least partially extending through the hole;

a first rotatable nut at least partially surrounding the first coil rod, wherein motion of the first rotatable nut adjusts a position of the vertical support portion to adjust a height of the horizontal panel, a second rotatable nut coupled to the first coil rod and supporting at least a portion of the horizontal support portion; and a second coil rod, wherein the vertical support portion of the support system is coupled to the first coil rod and the horizontal support portion of the support system is coupled to the second coil rod, and wherein, when the apparatus is mounted to a flange of a bridge girder, the second coil rod extends parallel to the flange of the bridge girder.

19. The apparatus of claim 18, wherein the support system is formed of a steel.

20. The apparatus of claim 18, further comprising:

a second rotatable nut coupled to the first coil rod and supporting at least a portion of the support system, wherein the apparatus is a stay-in-place form system configured to receive a concrete pour to form a bridge deck.

* * * * *